US006511349B2

(12) United States Patent
Ishikawa et al.

(10) Patent No.: US 6,511,349 B2
(45) Date of Patent: Jan. 28, 2003

(54) CONNECTION-RETAINING UNIT

(75) Inventors: Yasuhiro Ishikawa, Kanagawa (JP); Masao Suzuki, Kanagawa (JP)

(73) Assignee: Union Machinery Co., Ltd., Kanagawa (JP)

( * ) Notice: Subject to any disclaimer, the term of this patent is extended or adjusted under 35 U.S.C. 154(b) by 0 days.

(21) Appl. No.: 09/728,122

(22) Filed: Dec. 4, 2000

(65) Prior Publication Data

US 2001/0031577 A1 Oct. 18, 2001

(30) Foreign Application Priority Data

Mar. 24, 2000 (JP) ..... 2000-083757

(51) Int. Cl.[7] ..... H01R 24/00

(52) U.S. Cl. ..... 439/631; 439/67; 439/493; 439/327; 439/630

(58) Field of Search ..... 439/631, 630; 499/65–67, 328–329, 260, 493, 327

(56) References Cited

U.S. PATENT DOCUMENTS 3,771,100 A * 11/1973 Reed ..... 439/631
3,858,163 A * 12/1974 Goodman et al. ..... 439/631
4,488,763 A * 12/1984 Ritter ..... 439/493
4,623,207 A * 11/1986 Sasaki et al. ..... 439/11
5,277,621 A * 1/1994 Seto ..... 439/67
5,460,546 A * 10/1995 Kunishi et al. ..... 439/631
5,496,970 A * 3/1996 Spencer ..... 174/117 F
6,074,220 A * 6/2000 Roberts ..... 439/67

FOREIGN PATENT DOCUMENTS

JP 0054682 * 3/1989 ..... 439/631

OTHER PUBLICATIONS

Agard et al., "Card to Card Connector," Aug. 1963, IBM Technical Disclosure Bulletin, vol. 6, No. 3.*

* cited by examiner

*Primary Examiner*—Tho D. Ta
*Assistant Examiner*—Larisa Tsukerman
(74) *Attorney, Agent, or Firm*—Greenblum & Bernstein, P.L.C.

(57) ABSTRACT

A connection-retaining unit comprises a connection-retaining body, which includes a through-hole, a plate-like memory card, which is inserted into and extracted from the connection-retaining body, and a flexible printed board, which is also attached to and detached from the connection-retaining body. A plurality of connection terminals are provided in the through-hole, each connection terminal having a print side terminal portion and a memory side terminal portion. The print side terminal portions of the connection terminals are connected with the electrically conductive pathways of the flexible printed board, which are exposed at an end thereof, while the memory side terminal portions are connected with the terminals of the memory card, which are provided at a front end thereof.

8 Claims, 6 Drawing Sheets

CONNECTION-RETAINING UNIT

FIELD OF THE INVENTION

The present invention relates generally to a connection-retaining unit that establishes and retains electrical connection between a memory card which has terminals at an end thereof and a flexible printed board which has corresponding terminals at an end thereof. This connection-retaining unit includes a connecting member which receives the memory card and makes the memory card connect electrically with the printed board at the respective terminals.

BACKGROUND OF THE INVENTION

Nowadays, many items of electronic equipment are designed and manufactured in miniaturized forms with extra functions which are added by individual manufacturers to distinguish their products from the others'. For example, some video recorders are designed to utilize a small memory card for information storage in addition to their original function of recording information on video tape. In this case, information stored in the memory card can be transferred to and processed by, for example, a personal computer for more efficiently use of the information.

Such equipment can be sold as value-added products. However, there are some difficulties in assembling such products because miniaturized equipment has a limited volume, which provides only a small room for the installation of a memory card.

For example, a prior-art item of electronic equipment shown in FIG. 6 has a retaining member 5, which detachably receives a memory card 7. This retaining member 5 includes electric terminals 40, which are connected electrically with the terminals 19 of the memory card 7 which is inserted in the retaining member 5. The terminals 40 of the retaining member 5 are soldered respectively onto corresponding pads of an electrical circuit printed on an inflexible board 53. For the soldering of the terminals in the production of the miniaturized equipment, a refined soldering process is applied. However, because of difficulty involved in performing the delicate soldering work, there is a non-negligible rate of occurrence of soldering failures and of resultant incomplete or defective electrical connections. Furthermore, because the circuit board 53, onto which the terminals 40 of the retaining member 5 are soldered, is inflexible and not bendable, the degree of freedom of wiring in the equipment is relatively small. This condition is an obstacle in thinning and lightening the equipment even further or achieving a further miniaturization.

SUMMARY OF THE INVENTION

The present invention is conceived to solve the above mentioned problems. It is an object of the present invention to provide a connection-retaining unit which facilitates electrical wiring work of miniaturized electronic equipment and enables such equipment to be designed in a thinner and more compact form.

A connection-retaining unit according to the present invention comprises an electronic part (for example, the memory card 7 described in the following section) which has an electric terminal (for example, the terminals 19 of the following embodiment) at an end thereof, a retaining body which receives and retains the electronic part inserted therein, and a flexible printed board which has a printed electrical pathway whose terminal is provided at an end thereof (for example, the electrically conductive pathways 13 of the following embodiment, which are exposed at the front end). The flexible printed board is attachable to the retaining body by insertion thereinto, and it is also easily extractable from the retaining body. The retaining body has a connection terminal whose one end is electrically connected to the terminal of the electronic part and whose other end is electrically connected to the terminal of the flexible printed board when the electronic part and the printed board are received and retained in the retaining body.

With this connection-retaining unit, when the electronic part and the flexible printed board are inserted and retained in the retaining body, one end of the connection terminal is connected with the terminal of the electronic part while the other end of the connection terminal is connected with the terminal of the printed board. As a result, the electronic part is electrically connected to the flexible printed board through the connection terminal.

In comparison with a prior-art electronic connection in which the terminals of electrical wiring are soldered directly onto an inflexible circuit board, the present invention provides a connection-retaining unit which eliminates any possibility of incomplete soldering that may otherwise occur during production. As the flexible printed board used in the connection-retaining unit of the present invention can be bent with a high degree of freedom in assembled condition, the present invention enables further miniaturization of electronic equipment.

In the connection-retaining unit, it is preferable that the retaining body have a through-hole and that the connection terminal be provided in the through-hole. In this case, the electronic part is inserted through an opening of the through-hole while the terminal of the flexible printed board is inserted through the other opening of the through-hole. In this way, the electronic part and the flexible printed board are connected electrically through the connection terminal in the retaining body.

With this connection-retaining unit, the electronic part is electrically connected to the flexible printed board just by inserting the electronic part through one opening of the through-hole of the retaining body and the printed board through the other opening.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings, which are given by way of illustration only and thus are not limitative of the present invention and wherein:

FIG. 2 shows a flexible printed board which is a part of the connection-retaining unit. FIG. 2*a* is a plan view of the flexible printed board while

FIG. 3 shows the connection-retaining unit. FIG. 3*a* is a plan view of the-connection-retaining unit while

FIG. 4 shows the main body of the connection-retaining unit. FIG. 4*a* is a side view of the main body while

DESCRIPTION OF THE PREFERRED EMBODIMENTS

Figure 1:
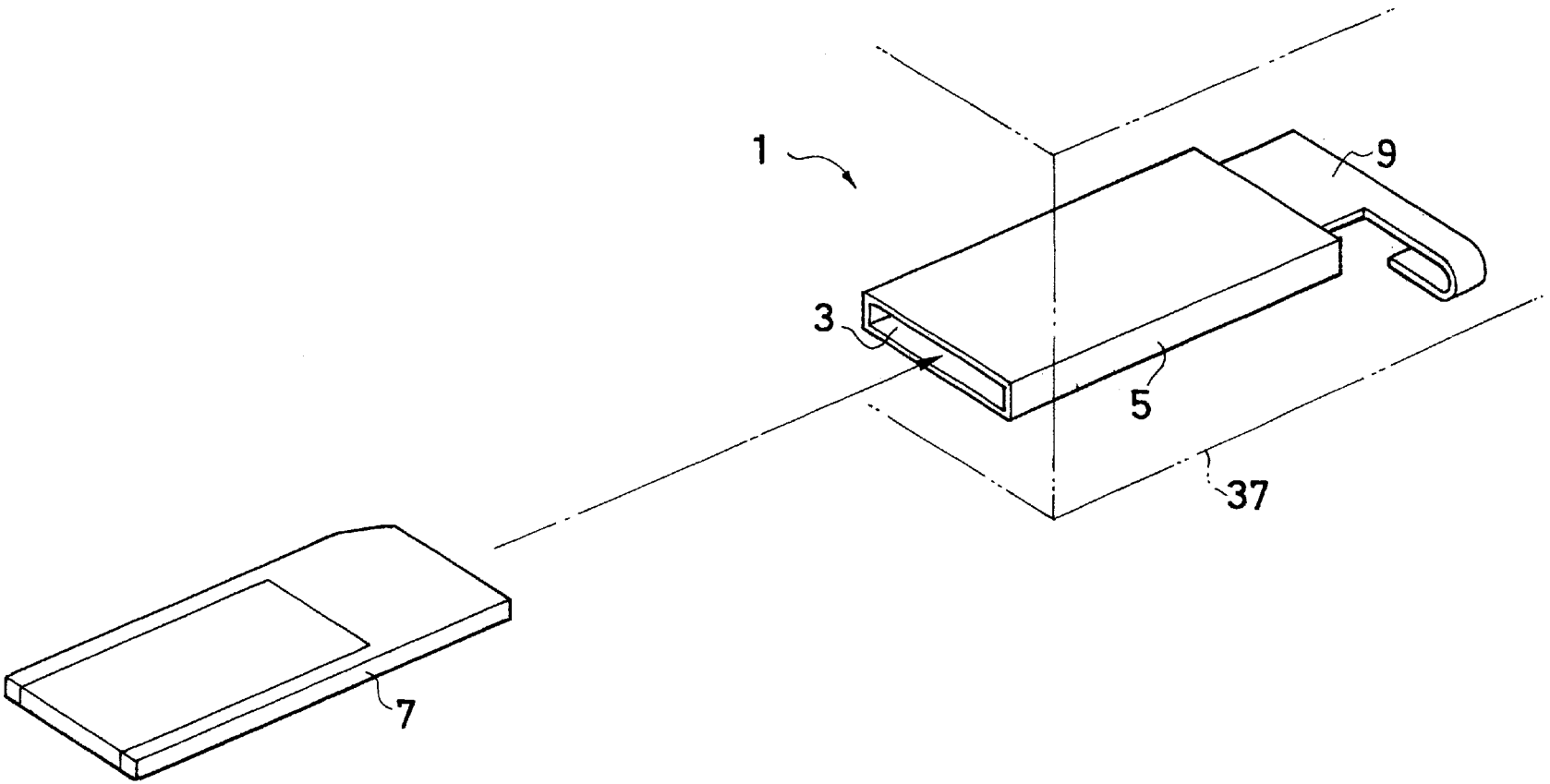
FIG. 1 is a perspective view of a preferred embodiment of connection-retaining unit according to the present invention.

A preferred embodiment of connection-retaining unit according to the present invention is hereinafter explained in reference to FIG. 1 through FIG. 5. The connection-retaining unit 1, which is connected to a flexible printed board 9, retains a memory card 7, which is installed therein. As shown in FIG. 1, the connection-retaining unit 1 comprises a connection-retaining body 5, the memory card 7 and the flexible printed board 9. As shown in FIGS. 1, 5*a* and 5*b*, flexible printed board 9 has a thickness which is substantially less than a thickness of memory card 7. The connection-retaining body 5 includes a through-hole 3 whose cross-section is rectangular, and the memory card 7 having a plate-like figure is inserted into the connection-retaining body 5. The memory card 7 is releasalble easily therefrom. Also, the flexible printed board 9 is attached to the connection-retaining body 5, and it is also detachable by a simple method.

Figure 2A:
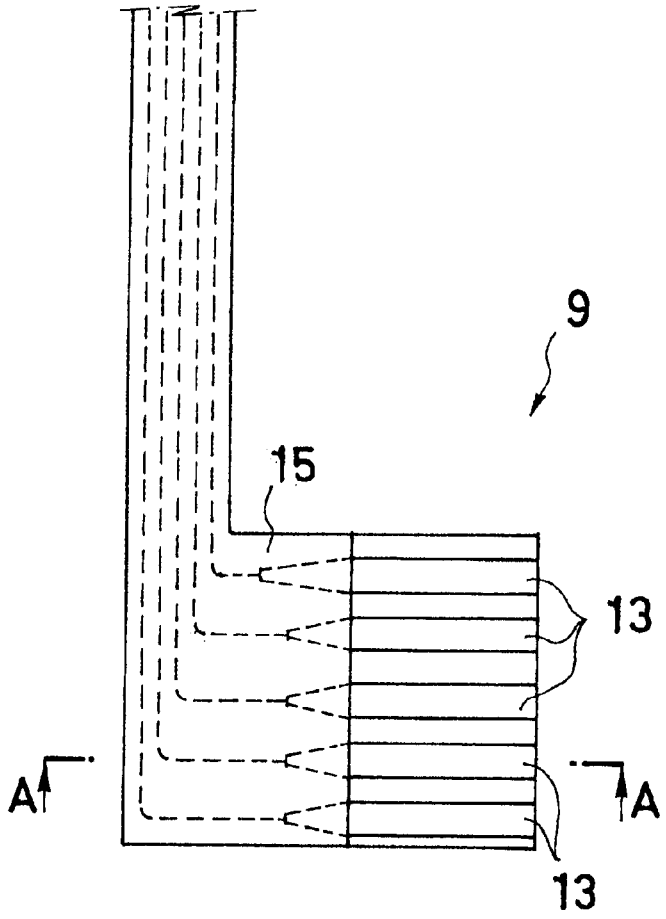
Figure 2B:
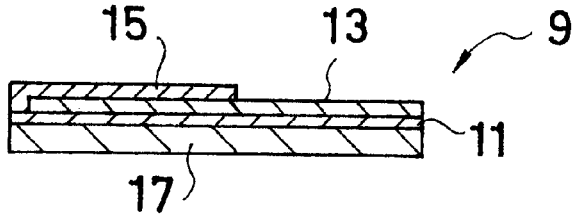
FIG. 2*b* is a sectional view taken along line A—A in FIG. 2*a*.

As shown in FIG. 2*b*, the flexible printed board 9 comprises a base board 11 made of a flexible material, a plurality of electrically conductive pathways 13 printed on the base board 11, and an electrically insulative layer 15, which covers the pathways 13. Additionally, an end of the flexible printed board 9 under the base board 11 is provided with a rigid member 17, which is not flexible and not easily bendable. In addition, as shown in FIG. 2*a*, the end of the flexible printed board 9 is not covered with the electrically insulative layer 15, so the pathways 13 are exposed upward.

Figure 3A:
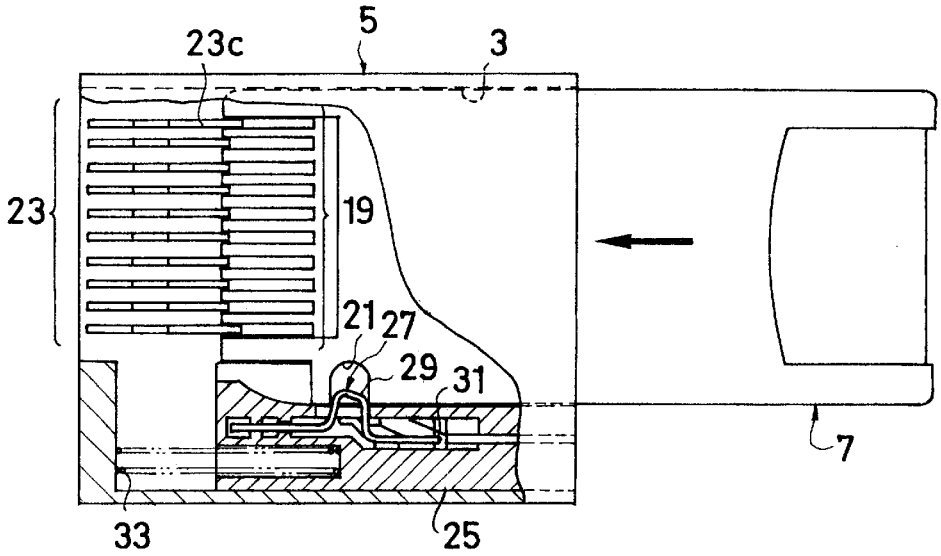

As shown in FIG. 3*a*, the memory card 7 has a plurality of terminals 19 in one end thereof, and the terminals 19 are arranged widthwise at a predetermined pitch. In addition, the memory card 7 includes a concave recess 21 at one side thereof.

Figure 4A:
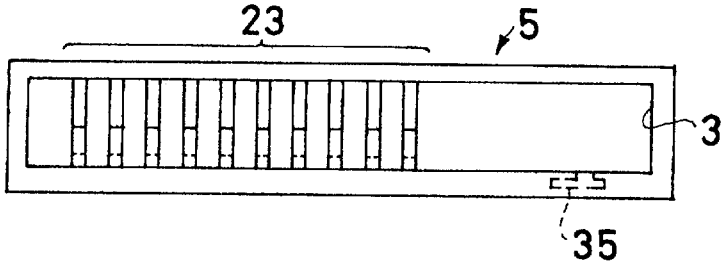
Figure 4B:
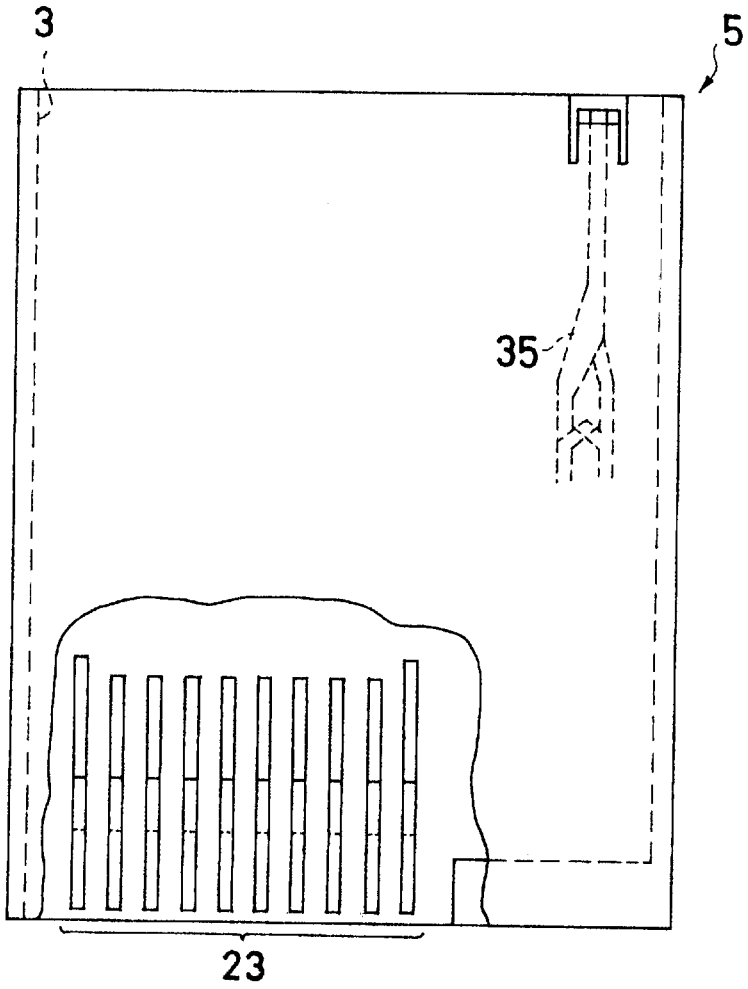
FIG. 4*b* is a plan view of the main body.
Figure 5A:
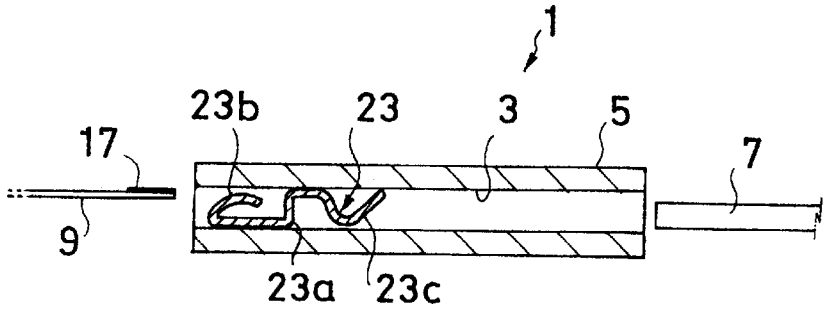
FIGS. 5*a* and 5*b* are sectional views of a connection terminal, which is used in the connection-retaining unit.
Figure 5B:
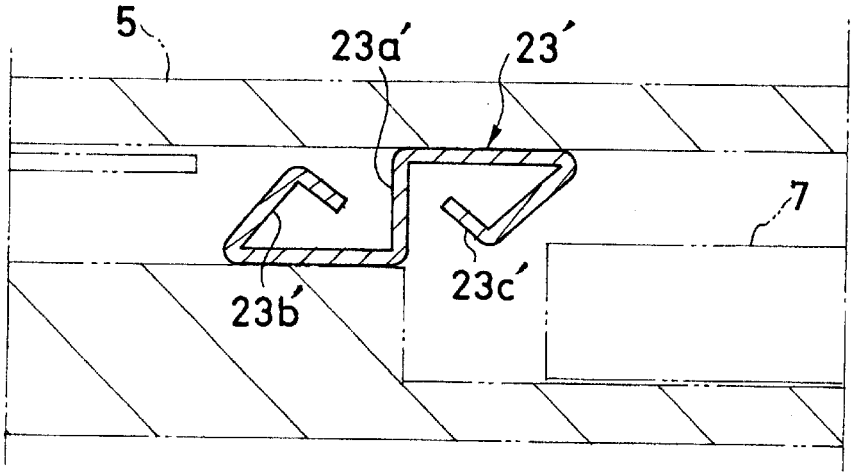
Figure 6:
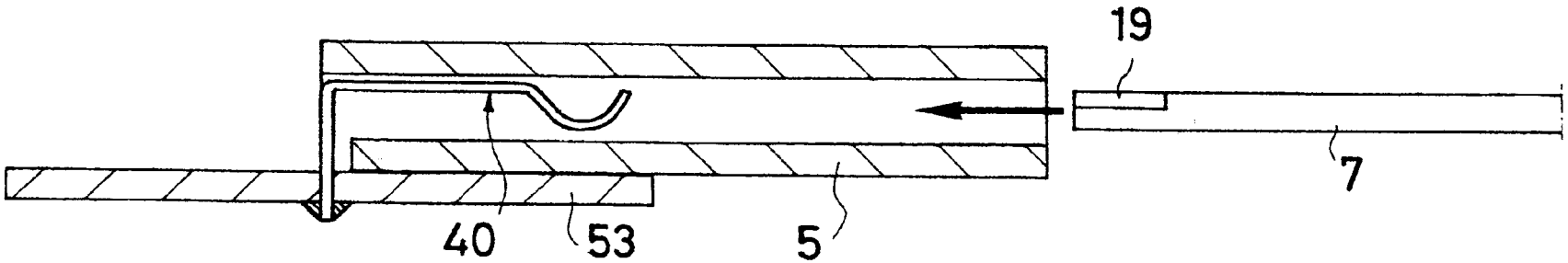
FIG. 6 is a sectional view of a prior-art connection-retaining unit, showing a prior-art connection terminal which is installed therein.

As shown in FIG. 4*b*, the connection-retaining body 5 includes a plurality of electrical conductors 23 as connection terminals at an end of the through-hole 3, and these terminals 23 are aligned laterally at the same pitch as that of the memory card 7. As shown in FIG. 5*a*, the connection terminals 23 are made of a metal which has a certain resiliency. Each connection terminal comprises a central plate portion 23*a*, a terminal portion located toward the flexible printed board 9 (referred to as "print side terminal portion 23*b*") and another terminal portion located toward the memory card 7 (referred to as "memory side terminal portion 23*c*"). The central plate portion 23*a* extends upward vertically, and the print side terminal portion 23*b* extends from the lower end of the central plate portion 23*a* toward the front end (left side of the drawing of FIG. 5*a*) of the connection-retaining body 5 and bends and returns upward and rearward in a folded figure. The memory side terminal portion 23*c* extends from the upper end of the central plate portion 23*a* toward the rear part of the connection-retaining body 5 and then bends downward and upward in a wave form. The central plate portions 23*a* of the connection terminals 23 are press-fit into the through-hole 3 and fixed therein. The print side terminal portion 23*b* of each connection terminal 23 is capable of swinging around the base thereof (i.e., the part where it connects with the central plate portion 23*a*) in the up and down direction, and the memory side terminal portion 23*c* is capable of swinging around the top of the central plate portion 23*a* also in the up and down direction.

As shown in FIG. 5*b*, the connection terminals 23 can be designed to have a rotation symmetry. In this design, each connection terminal 23' also comprises a central plate portion 23*a*', a print side terminal portion 23*b*' and a memory side terminal portion 23*c*', and the print side terminal portion 23*b*' extends from the lower end of the central plate portion 23*a*' toward the front end (left side of the drawing of FIG. 5*b*) of the connection-retaining body 5 and bends and returns upward and rearward (rightward in FIG. 5*b*) and then downward and rearward. The memory side terminal portion 23*c*' extends from the upper end of the central plate portion 23*a*' toward the rear part of the connection-retaining body 5 and then bends forwardly (leftward in FIG. 5*b*) downward and upward curling inwardly. Also, each connection terminal 23 may be designed to have a mirror image of the connection terminal 23' shown in FIG. 5*b*.

As shown in FIG. 5*b*, the connection terminals 23 can be designed to have a rotation symmetry. In this design, each connection terminal 23' also comprises a central plate portion 23*a*', a print side terminal portion 23*b*' and a memory side terminal portion 23*c*', and the print side terminal portion 23*b*' extends from the lower end of the central plate portion 23*a*' toward the front end (left side of the drawing of FIG. 5*b*) of the connection-retaining body 5 and bends and returns upward and rearward (rightward in FIG. 5*b*) and then downward and rearward. The memory side terminal portion 23*c*' extends from the upper end of the central plate portion 23*a*' toward the rear part of the connection-retaining body 5 and then bends forwardly (leftward in FIG. 5*b*) downward and upward curling inwardly. Also, each connection terminal 23 may be designed to have a mirror image of the connection terminal 23' shown in FIG. 5*b*. As shown in FIG. 5*b*, the through-hole in this embodiment has a first opening in which the memory card 7 is inserted, and a smaller second opening in which the flexible printed board 9 is inserted.

Now, a description is made of the operation of the connection-retaining unit 1. A worker (not shown) inserts the one end of the flexible printed board 9 shown in FIG. 2*b* into the front end of the through-hole 3 of the connection-retaining body 5 shown in FIG. 5*a* by holding the flexible printed board 9 with the electrically conductive pathways 13 facing downward. Upon the insertion, the electrically conductive pathways 13 shown in FIG. 2*a* meet and push the print side terminal portions 23*b* of the connection terminals 23, bending them elastically downward. When the flexible printed board 9 is assembled to the connection-retaining body 5 in this way, the end of the flexible printed board 9 reaches a predetermined position in the connection-retaining body 5, and it is held firmly between the print side terminal portions 23*b* of the connection terminals 23 and the internal wall of the through-hole 3. In this condition, the electrically conductive pathways 13 of the flexible printed board 9, which are exposed at the end thereof, are connected electrically to the corresponding print side terminal portions 23*b*.

As shown in FIG. 1, the flexible printed board 9, which is attached to the connection-retaining body 5, can be bent as necessary to incorporated the connection-retaining unit 1 in a small space which is available in an item of electronic equipment 37. In this way, the connection terminals 23 of the connection-retaining body 5 are connected relatively easily through the flexible printed board 9 to the corresponding terminals of another electronic part (not shown) in the electronic equipment 37.

Figure 3B:
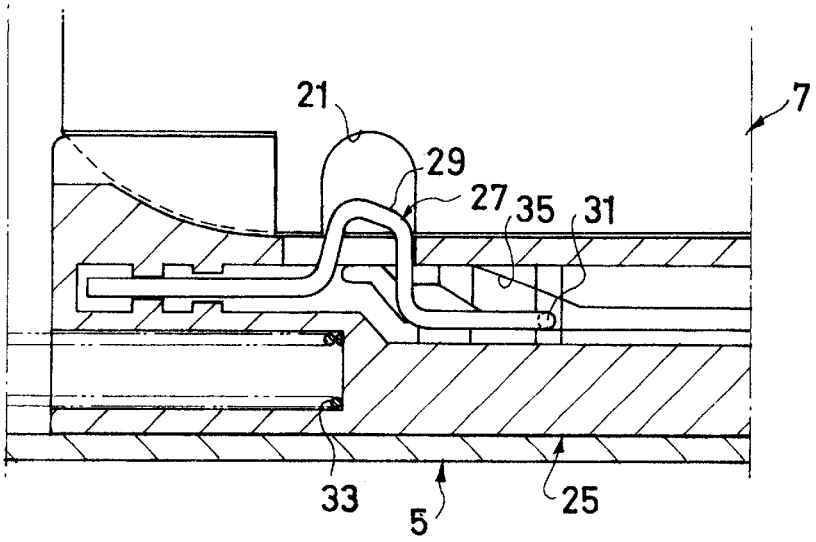
FIG. 3*b* is a plan view of a slider.

Then, to install the memory card 7 in the connection-retaining body 5, to which the flexible printed board 9 is attached, the memory card 7 is inserted into the through-hole 3, with the terminals 19 of the memory card 7 facing the connection-retaining body 5 as shown in FIG. 3*a*. As the memory card 7 is pushed into the through-hole 3, a side of the memory card 7 slides on a side of the slider 25. At first, the slider 25 moves with the memory card 7 toward the front end of the connection-retaining body 5, and the terminals 19 of the memory card 7 come into contact with the memory side terminal portions 23*c* of the connection terminals 23. Simultaneously, the cam protrusion 31 of the slider 25 moves along the cam groove 35 as shown in FIG. 3*b* and comes to a predetermined position where the memory card 7 is fixed in the connection-retaining body 5, with the terminals 19 of the memory card 7 being electrically connected with the memory side terminal portions 23*c* of the connection terminals 23, respectively. In this condition, the terminals 19 of the memory card 7 are electrically connected through the connection terminals 23 to the electrically conductive pathways 13 of the flexible printed board 9.

In the above embodiment, the connection-retaining unit 1 is described with the connection terminals 23, which are shown in FIG. 5*a*. However, the present invention is not limited to this example. The connection terminals 23', which are shown in FIG. 5*b*, can be applied in the same way. In this case, however, the connection terminals 23' can be assembled into the connection-retaining body 5 without much attention on their orientation because the connection terminals 23' are in a form of rotation symmetry.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims. The efficiency of the assembly work can be improved by using this type of connection terminals.

RELATED APPLICATIONS

This application claims the priority of Japanese Patent Application No.2000-83757 filed on Mar. 24, 2000, which is incorporated herein by reference.

What is claimed is:

1. A connection-retaining unit comprising:

a retaining body including a first end surface and a second end surface opposite to said first end surface, said retaining body further including a through-hole extending through said retaining body between a first opening in said first end surface and a second opening in said second end surface, said through-hole including first and second opposed internal walls extending from said first opening to said second opening, said first and second opposed internal walls being spaced from one another by a substantially equal distance along the entire extent of said through-hole, such that said through-hole is of a substantially uniform size along the entire extent thereof;

an electronic part including an electric terminal at a first end thereof having a first thickness, said first end of said electronic part being insertable into and removable from said through-hole through said first opening in said first end surface of said retaining body; and a flexible printed board including a printed electrical pathway with a terminal at a first end thereof having a second thickness which is substantially less than said first thickness, said first end of said flexible printed board being insertable into and removable from said through-hole through said second opening in said second end surface of said retaining body;

said retaining body further including an asymmetrically formed connection terminal located in said through-hole, said connection terminal including a first end portion configured to contact and be electrically connected to said terminal of said first end of said electronic part inserted through said first opening, and a second end portion configured to contact and be electrically connected to said terminal of said first end of said flexible printed board inserted through said second opening, said first end portion of said connection terminal having a structural configuration which is different than a structural configuration of said second end portion of said connection terminal, such that said first end portion of said connection terminal is configured for engagement with said terminal of said first end of said electronic part having said first thickness, while said second end portion of said connection terminal is configured for engagement with said terminal of said first end of said flexible printed board having said second thickness which is substantially less than said first thickness;

wherein said terminal of said first end of said electronic part inserted through said first opening is held between said first end portion of said connection terminal and said first internal wall of said through-hole, such that said terminal of said first end of said electronic part is electrically connected with said first end portion of said connection terminal, and said terminal of said first end of said flexible printed board inserted through said second opening is held between said second end portion of said connection terminal and said second internal wall of said through-hole, such that said terminal of said first end of said flexible printed board is electrically connected with said second end portion of said connection terminal.

2. The connection-retaining unit as set forth in claim 1, wherein:

said connection terminal is made of a metal having a level of elasticity, formed as a unitary body including said first end portion and said second end portion, and further including a central plate portion connecting said first end portion and said second end portion, said central plate portion being press-fit and fixed in said through-hole between said first and second opposed internal walls, said first end portion extending from said central plate portion toward said first opening, and said second end portion extending from said central plate portion toward said second opening.

3. A connection-retaining unit comprising:

a retaining body including a first end surface and a second end surface opposite to said first end surface, said retaining body further including a through-hole extending through said retaining body between a first opening in said first end surface and a second opening in said second end surface, wherein said second opening is substantially smaller than said first opening, said through-hole including first and second opposed internal walls extending from said first opening to said second opening, said first and second opposed internal walls being spaced from one another by a first distance along a first portion of said through-hole which extends from said first opening, and said first and second opposed internal walls being spaced from one another by a second distance along a second portion of said through-hole which extends from said second opening, wherein said second distance is substantially less than said first distance, such that said second portion of said through-hole is substantially smaller than said first portion of said through-hole;

an electronic part including an electric terminal at a first end thereof having a first thickness, said first end of said electronic part being insertable into and removable from said first portion of said through-hole through said first opening in said first end surface of said retaining body; and a flexible printed board including a printed electrical pathway with a terminal at a first end thereof having a second thickness which is substantially less than said first thickness, said first end of said flexible printed board being insertable into and removable from said second portion of said through-hole through said second opening in said second surface of said retaining body;

said retaining body further including a connection terminal press-fit and fixed between said first and second opposed internal walls in said second portion of said through-hole at a position adjacent to said first portion of said through-hole, said connection terminal including a first end portion extending into said first portion of said through-hole and configured to contact and be electrically connected to said terminal of said first end of said electronic part inserted through said first opening, and a second end portion extending into said second portion of said through-hole and configured to contact and be electrically connected to said terminal of said first end of said flexible printed board inserted through said second opening which is substantially smaller than said first opening, said first end portion of said connection terminal having a structural configuration which is substantially the same as a structural configuration of said second end portion of said connection terminal, such that said first end portion of said connection terminal is configured for engagement with said terminal of said first end of said electronic part having said first thickness, in said first portion of said through-hole, while said second end portion of said connection terminal is configured for engagement with said terminal of said first end of said flexible printed board having said second thickness which is substantially less than said first thickness, in said second portion of said through-hole.

4. The connection-retaining unit as set forth in claim 3, wherein:

said connection terminal is made of a metal having a level of elasticity, formed as a unitary body including said first end portion and said second end portion, and further including a central plate portion connecting said first end portion and said second end portion, said central plate portion being press-fit and fixed between said first and second opposed internal walls in said second portion of said through hole at said position adjacent to said first portion of said through-hole, said first end portion extending from said central plate portion into said first portion of said through-hole toward said first opening, and said second end portion extending from said central plate portion into said second portion of said through-hole toward said second opening.

5. The connection-retaining unit as set forth in claim 4, wherein said connection terminal is formed in rotational symmetry around said central plate portion.

6. The connection-retaining unit as set forth in claim 4, wherein:

said terminal of said first end of said electronic part inserted through said first opening is held between said first end portion of said connection terminal and said first internal wall of said through-hole, such that said terminal of said first end of said electronic part is electrically connected with said first end portion of said connection terminal; and said terminal of said first end of said flexible printed board inserted through said second opening is held between said second end portion of said connection terminal and said second internal wall of said through-hole, such that said terminal of said first end of said flexible printed board is electrically connected with said second end portion of said connection terminal.

7. The connection-retaining unit as set forth in claim 6, wherein said connection terminal is formed in rotational symmetry around said central plate portion.

8. The connection-retaining unit as set forth in claim 3, wherein said connection terminal is formed in rotational symmetry.

* * * * *